US007958681B2

(12) United States Patent
Moller, Jr.

(10) Patent No.: US 7,958,681 B2
(45) Date of Patent: Jun. 14, 2011

(54) MODULAR FLOOR TILE WITH NONSLIP INSERT SYSTEM

(76) Inventor: Jorgen J. Moller, Jr., Salt Lake City, UT (US)

( * ) Notice: Subject to any disclaimer, the term of this patent is extended or adjusted under 35 U.S.C. 154(b) by 873 days.

(21) Appl. No.: 11/291,002

(22) Filed: Nov. 30, 2005

(65) Prior Publication Data

US 2006/0272252 A1 Dec. 7, 2006

Related U.S. Application Data

(63) Continuation-in-part of application No. 11/143,337, filed on Jun. 2, 2005, now Pat. No. 7,571,572.

(51) Int. Cl.
*E04F 11/16* (2006.01)

(52) U.S. Cl. ..... 52/181; 52/386; 52/403.1; 52/592.1

(58) Field of Classification Search ..... 52/181, 52/180, 177, 403.1, 386, 384, 480, 512, 592.1; 108/64, 54.1; 472/90, 92
See application file for complete search history.

(56) References Cited

U.S. PATENT DOCUMENTS

| | | | | |
|---|---|---|---|---|
| 738,704 | A | 9/1903 | Semmer | |
| 841,998 | A * | 1/1907 | Mulford | 52/584.1 |
| 1,328,875 | A * | 1/1920 | Herbert | 52/181 |
| 1,420,775 | A | 6/1922 | Stanwood | |
| 1,625,187 | A | 4/1927 | Birch | |
| 1,722,139 | A * | 7/1929 | Galassi | 404/19 |
| 1,765,652 | A | 6/1930 | Burgess | |
| D93,991 | S | 12/1934 | Moore | |
| 2,853,854 | A | 9/1958 | Burton et al. | |
| 3,015,136 | A | 1/1962 | Doe | |
| 3,093,870 | A | 6/1963 | Brock | |
| 3,196,763 | A | 7/1965 | Rushton | |
| 3,279,138 | A | 10/1966 | Dittmar | |
| 3,284,819 | A | 11/1966 | Nissen | |
| 3,289,375 | A | 12/1966 | Cline | |
| 3,319,392 | A | 5/1967 | Fitzgerald | |
| 3,438,312 | A * | 4/1969 | Becker et al. | 404/40 |
| 3,452,497 | A | 7/1969 | Warp | |
| 3,717,247 | A | 2/1973 | Moore | |
| 3,721,460 | A | 3/1973 | Holman et al. | |
| 3,741,411 | A | 6/1973 | Peacock | |

(Continued)

FOREIGN PATENT DOCUMENTS

DE 3545969 9/1986

(Continued)

OTHER PUBLICATIONS

Definition of protruding: www.wordnet.princeton.edu/perl/webwn.*

(Continued)

*Primary Examiner* — Brian E Glessner
*Assistant Examiner* — Adriana Figueroa
(74) *Attorney, Agent, or Firm* — Holland & Hart

(57) ABSTRACT

The principles described herein provide floor tiles and modular floors. The floor tiles include inserts that increase traction. The inserts may be removable and protrude from a top surface of the floor tiles. The tiles may include a locking system that allows adjacent tiles to interlock, while also permitting a predetermined amount of lateral sliding relative to one another. The modular tiles may be injection molded and the inserts may comprise an elastomer. The floor tiles may also provide four layers of traction, providing more sure footing than previous flooring systems.

29 Claims, 5 Drawing Sheets

U.S. PATENT DOCUMENTS

| | | | | | |
|---|---|---|---|---|---|
| 3,861,592 | A | | 1/1975 | Fisher | |
| 3,909,996 | A | * | 10/1975 | Ettlinger et al. | 52/177 |
| 4,008,548 | A | | 2/1977 | Leclerc | |
| 4,054,987 | A | | 10/1977 | Forlenza | |
| 4,133,481 | A | | 1/1979 | Bennett | |
| 4,211,366 | A | | 7/1980 | Czarnota | |
| 4,226,060 | A | | 10/1980 | Sato | |
| 4,287,693 | A | | 9/1981 | Collette | |
| 4,296,160 | A | * | 10/1981 | Forlenza | 428/117 |
| 4,436,779 | A | | 3/1984 | Menconi et al. | |
| 4,440,818 | A | * | 4/1984 | Buchan et al. | 428/99 |
| 4,543,765 | A | | 10/1985 | Barrett | |
| 4,584,221 | A | | 4/1986 | Kung | |
| 4,715,743 | A | | 12/1987 | Schmanski | |
| 4,826,351 | A | | 5/1989 | Haberhauer et al. | |
| 4,860,510 | A | | 8/1989 | Kotler | |
| 4,879,857 | A | | 11/1989 | Peterson et al. | |
| 4,930,286 | A | | 6/1990 | Kotler | |
| 5,014,488 | A | | 5/1991 | Evangelos et al. | |
| 5,033,241 | A | | 7/1991 | Max | |
| 5,220,785 | A | | 6/1993 | Miller | |
| 5,275,502 | A | | 1/1994 | Glaza et al. | |
| 5,277,010 | A | | 1/1994 | Stephenson et al. | |
| 5,323,575 | A | * | 6/1994 | Yeh | 52/177 |
| 5,364,204 | A | | 11/1994 | MacLeod | |
| 5,403,637 | A | * | 4/1995 | Pickard et al. | 428/44 |
| 5,433,070 | A | | 7/1995 | Amelio | |
| 5,492,069 | A | * | 2/1996 | Alexander et al. | 108/56.3 |
| 5,509,244 | A | * | 4/1996 | Bentzon | 52/387 |
| 5,527,128 | A | | 6/1996 | Rope et al. | |
| 5,587,218 | A | * | 12/1996 | Betz | 428/67 |
| D383,253 | S | | 9/1997 | Semenuk | |
| D385,974 | S | | 11/1997 | Berger | |
| D385,978 | S | | 11/1997 | Berger | |
| 5,749,787 | A | * | 5/1998 | Jank | 472/92 |
| 5,761,867 | A | * | 6/1998 | Carling | 52/386 |
| 5,787,654 | A | | 8/1998 | Drost | |
| 5,807,021 | A | | 9/1998 | Aaron | |
| 5,815,995 | A | | 10/1998 | Adam | |
| 5,833,386 | A | | 11/1998 | Rosan et al. | |
| 5,904,021 | A | * | 5/1999 | Fisher | 52/578 |
| 5,950,378 | A | | 9/1999 | Council et al. | |
| 5,992,106 | A | | 11/1999 | Carling et al. | |
| 6,061,979 | A | | 5/2000 | Johannes | |
| 6,089,784 | A | | 7/2000 | Ardern | |
| 6,098,354 | A | | 8/2000 | Skandis | |
| D456,533 | S | | 4/2002 | Moller, Jr. | |
| D462,792 | S | | 9/2002 | Ogawa | |
| 6,467,224 | B1 | * | 10/2002 | Bertolini | 52/177 |
| 6,526,705 | B1 | | 3/2003 | MacDonald | |
| D481,470 | S | | 10/2003 | Moller, Jr. | |
| 6,751,912 | B2 | | 6/2004 | Stegner et al. | |
| 6,802,159 | B1 | | 10/2004 | Kotler | |
| 6,878,430 | B2 | | 4/2005 | Milewski et al. | |
| D516,737 | S | | 3/2006 | Moller, Jr. | |
| 7,211,314 | B2 | * | 5/2007 | Nevison | 428/143 |
| 7,575,795 | B2 | | 8/2009 | Scott et al. | |
| 2002/0189176 | A1 | * | 12/2002 | Stegner et al. | 52/177 |
| 2004/0244320 | A1 | | 12/2004 | Kalisiak et al. | |
| 2005/0034395 | A1 | * | 2/2005 | Kotler | 52/384 |
| 2005/0193669 | A1 | * | 9/2005 | Jenkins et al. | 52/392 |
| 2005/0223666 | A1 | | 10/2005 | Forster et al. | |

FOREIGN PATENT DOCUMENTS

| | | | |
|---|---|---|---|
| GB | 1226297 | | 3/1971 |
| GB | 2262437 | A | 6/1993 |
| JP | 02236355 | | 9/1990 |

OTHER PUBLICATIONS

Athletic Business, advertisement for Flexideck, p. 81; advertisement for Sport Floor, p. 53; advertisement for Basic Coatings Sports, p. 43, Mar. 2001.

Athletic Business, advertisement for Hid-N-Lok School Color Series tiles; advertisement for Fitness Flooring, p. 29; advertisement for Mitchell Rubber Products, p. 30; advertisement for Loktuff, p. 34; advertisement for Dri-Dek, p. 74, advertisement for Tepromark, p. 77; advertisement forHaro Sports Floors, p. 100; advertisement for Plexipave, p. 127; advertisement for Aacer Flooring, p. 226; advertisement for Spidertile, p. 236; advertisement for Mateflex, p. 259; advertisement for SportCourt pp. 280-81; Feb. 2004.

Brochure, "It's Not Just a Sports Floor," Sport Court Performance Sports Flooring, date unknown. A Complete Guide to Sports Surfaces and Flooring, advertisement for Sport Court, p. 5; advertisement for Multi-Play Sports Flooring, p. 9; advertisement for Rubber Products, p. 9; advertisement for SnapCourt Floors, p. 12; advertisement for PlayGuard, p. 15; advertisment for American Sports Builders Association, p. 15; advertisement for "Unity" Surfacing Systems, p. 22; advertisement for Dynamic Sports Constructions, Inc., p. 22; advertisement for Versacourt, p. 23; advertisement for Swiss Flex, p. 26; advertisement for SportMaster Sport Surfaces, p. 26; advertisement for Centaur Floor Systems, p. 30; advertisement for All Deck, p. 30; Jul./Aug. 2005.

Program for AVCA 2003 Annual Convention, advertisement for Mateflex, p. 12, Dec. 2003.

Athletic Business, advertisement for Dri-Dek, p. 47; advertisement for Mateflex, p. 97; advertisement for Duragrid, p. 132; advertisement for Kiefer Specialty Flooring, Inc., p. 134, Dec. 2003.

Athletic Business, advertisement for Mateflex, p. 16; advertisement for Aacer Flooring, p. 41; advertisement for Sport Court, p. 50; advertisement for Dri-Dek, p. 83; advertisements for Horner Flooring Co., Kiefer Specialty Flooring, Inc., and Mateflex-Mele Corp., p. 103; advertisements for Oscoda Plastics, Inc. and Primier Tiles, p. 104; advertisements for Spidercourt, Inc., Sport Court, Inc., Sport Floors, Inc., Sporturf, Sprinturf, Sri Sports, Inc., Superior Floor Company Inc., and Synthetic Surfaces, p. 106; Nov. 2003.

Athletic Business, advertisements for Dri-Dek and Fitness Flooring, p. 77; advertisements for Dri-Dek/Kendall Products and Duragrid, p. 91; advertisement for Mateflex-Mele Corp., p. 94; advertisements for Dri-Dek/Kendall Products, Dodge-Regupol, Inc., p. 104, Jul. 2002.

Athletic Business, advertisement for Dri-Dek, p. 83; Jul. 2004.

Athletic Business, advertisement for Aacer Flooring, p. 10; advertisement for SnapCourt Sports Floor, p. 14; advertisement for Dri-Dek, p. 65; advertisement for Matexlfex, p. 231; advertisement for Sport Court, p. 241-43; advertisements for ProLine SPF and Swiss Flex, p. 245, Feb. 2005.

Athletic Business, advertisement for Dri-Dek, p. 12; advertisement for Mateflex, p. 91; advertisements for Dri-Dek, Everlast Performance Flooring, p. 112; advertisement for Mateflex, p. 115, Aug. 2005.

Athletic Business, advertisement for Mateflex, p. 51; advertisement for Dri-Dek, p. 63; advertisement for Dri-Dek, p. 96, Aug. 2004.

Recreation Management, advertisements for Taraflex Sports Flooring, Aacer Flooring, LLC, Action Floor Systems, Aeson Flooring Systems, Centaur Floor Systems, LLC; Swiss Flex, Sport Court International, p. 217; advertisements for Mitchell Rubber Products, Fitness Flooring, Summit Flexible Products, Premier Court, p. 218; advertisement for Aacer Flooring, p. 221; advertisements for SportMaster Sport Surfaces and Swiss Flex, p. 227; advertisement for Sport Court, p. 229, Dec. 2004.

Grassroots Motor Sports, advertisement for RaceDeck, p. 61; Article, "Floored—Two Ways to Make Your Shop Floor Look Beautiful," pp. 125-126, Mar. 2002.

Athletic Business, advertisement for Dri-Dek, p. 55; advertisements for Rubber Products and Multi-Play Sports Flooring, p. 139; advertisement for Fitness Flooring, p. 167; advertisement for Mateflex, p. 233; advertisements for Centaur Floor Systems and Flex Court, p. 250; advertisement for Athletic Surface Systems (Sport Court), p. 281-84, Feb. 2006.

Club Management, advertisement for Duragrid, p. 161; Apr. 2002.

Athletic Business, advertisement for Sport Court, p. 39; advertisement for Dri-Dek, p. 49; advertisement for VersaCourt, p. 93, Sep. 2004.

Recreation Management, advertisement for Sport Court, p. 9; advertisement for Dri-Dek, p. 21, May/Jun. 2005.

Athletic Business, advertisement for Dri-Dek, p. 16; advertisement for SpiderTile, p. 20; advertisement for Mateflex, p. 69; advertisements for Premier Tiles, Prestige Enterprises International, Inc., Rhino Sports, and Robbins Sports Surfaces, p. 139; advertisements for SpiderCourt Inc., Sport Court, Inc. and Sport Floors, Inc., p. 141, Apr. 2003.

Institutional Flooring, Competitive Information, Sport Court, Jan. 2004.

Advertisement for IceCourt XS, date unknown.

Brochure for Mateflex, 8 pages, date unknown.

* cited by examiner

MODULAR FLOOR TILE WITH NONSLIP INSERT SYSTEM

RELATED APPLICATIONS

This is a continuation-in-part of U.S. patent application Ser. No. 11/143,337 filed 2 Jun. 2005 now U.S. Pat. No. 7,571,572 and entitled "Modular Floor Tile System with Sliding Lock."

TECHNICAL FIELD

This relates generally to floor tiles, and more particularly to nonslip modular floor systems.

BACKGROUND

Floor tiles have traditionally been used for many different purposes, including both aesthetic and utilitarian purposes. For example, floor tiles of a particular color may be used to accentuate an object displayed on top of the tiles. Alternatively, floor tiles may be used to simply protect the surface beneath the tiles from various forms of damage. Floor tiles typically comprise individual panels that are placed on the ground either permanently or temporarily depending on the application. A permanent application may involve adhering the tiles to the floor in some way, whereas a temporary application would simply involve setting the tiles on the floor. Some floor tiles can be interconnected to one another to cover large floor areas such as a garage, an office, or a show floor. Other interconnected tile systems are used as dance floors and sports court surfaces. However, the top surface of typical interconnected tile systems is often slippery.

Various surface structures have been utilized with the interconnected tile systems to increase traction and reduce the occurrence of slipping accidents. Some tile systems include solid top surfaces with raised features. The raised features include raised circles and diamond patterns. Other tile systems, particularly sports-related tile systems, have open top surfaces to allow the passage of water and other debris therethrough. The open top surfaces of typical sports court tile systems, however, have no additional features to increase traction. Therefore, there is a need for modular interconnected tile systems that include open top surfaces and provide for increased traction.

SUMMARY

Some embodiments address the above-described needs and others. In one of many possible embodiments, a modular floor tile is provided. The modular floor tile comprises a first open surface, a plurality of edge surfaces, and an interlocking mechanism for attachment to adjacent tiles. The modular floor tile also includes at least one insert disposed in at least one gap of the first open surface. The insert protrudes from the first open surface and improves traction. The insert may comprise a base and a post extending from the base. The base may be a generally circular base, and the post may comprise a generally cylindrical post extending from the base. According to some embodiments, a lip extends radially from an end of the generally cylindrical post. The insert may comprises a base, a compressible column, and a pad. A force on the pad causes the compressible column to compress, wherein the pad may be forced to a generally flush arrangement with the first open surface without displacing the base.

According to some embodiments of the modular floor tile, the at least one gap of the first open surface may comprise a plurality of shapes arranged in a pattern. Accordingly, the post of the insert may be sized small enough to pass through one of the plurality of shapes, and the base may be sized large enough to resist passage through one of the plurality of shapes. The insert may straddle the open first surface at the plurality of gaps. For example, the insert may comprise an elastomeric removable insert comprising a post having first and second lips, and the first and second lips straddle the open first surface at the plurality of gaps. The first and second lips may resist dislocation of the insert into or out of the at least one gap.

According to some embodiments of the modular floor tile, the interlocking mechanism comprises a plurality of lipped loops disposed in at least one of the plurality of edge surfaces, and a plurality of locking tab assemblies disposed in at least one of the plurality of edge surfaces. Each of the plurality of locking tab assemblies comprises a center post and flanking hooks.

Another aspect provides an apparatus comprising a modular floor. The modular floor comprises a plurality of interlocking tiles. Each of the plurality of interlocking tiles comprises a top surface comprising a plurality of open holes and a nonslip insert protruding from the top surface through at least one of the plurality of open holes. Each of the plurality of interlocking tiles may comprise a bottom, the bottom including a plurality of receivers each sized to hold a nonslip insert. The nonslip inserts may comprise a resilient member disposed through one of the plurality of open holes and held in place by an interference fit with a holder in one of the plurality of interlocking tiles. The nonslip insert may comprise a post having first and second ends and first and second lips at the first and second ends, respectively. However, the first lip may be smaller than the second lip, and the second lip is sized to resist passage through any of the plurality of open holes.

According to some embodiments of the modular floor, each of the plurality of interlocking tiles further comprises a plurality of support legs extending down from the first open surface. The plurality of support legs comprises a first set of support legs having a first length, and a second set of support legs having a second length. The second length is shorter than the first length. The first and second sets of support legs are arranged in an alternating pattern. The alternating pattern comprises a first leg of the first length, and a group of three or four legs of the second length. The nonslip insert may be nested in the group of three or four legs.

Another aspect provides a method of increasing traction of a modular floor. The method comprises providing an interlocking modular tile having a first open surface, inserting an insert into a surface of the interlocking modular tile, and protruding the insert from the first open surface. Inserting may further comprise fitting the insert into a nest by an interference fit. Inserting may also comprise pressing the insert through a gap in the first open surface in a first direction Another aspect provides a method of making a modular tile. The method comprises forming a tile body having a plurality of open shapes, providing a plurality of elastomeric inserts, and pressing the plurality of elastomeric inserts into at least some of the plurality of open shapes. The method may further comprise maintaining an orientation of the plurality of elastomeric inserts by deforming each insert into a tight fit with the tile body. Providing a plurality of elastomeric inserts may include forming a post with first and second lips. In addition, pressing the plurality of elastomeric inserts may comprise straddling an upper surface of the tile body with the first and second lips. Providing a plurality of elastomeric inserts may also comprise forming a post with first and second lips, wherein the first and second lips are sized to resist displacement through the plurality of open shapes. Pressing the plurality of elastomeric inserts may comprise straddling an upper surface of the tile body with the first and second lips.

The foregoing features and advantages, together with other features and advantages, will become more apparent when referring to the following specification, claims and accompanying drawings.

BRIEF DESCRIPTION OF THE DRAWINGS

The accompanying drawings illustrate various embodiments and are a part of the specification. The illustrated embodiments are merely examples and do not limit the claims.

Throughout the drawings, identical reference numbers designate similar, but not necessarily identical, elements.

DETAILED DESCRIPTION

As mentioned above, typical modular flooring comprises solid or open top surfaces that tend to be slippery. The slippery surfaces compromise the footing of users, especially sports court users that tend to start and stop abruptly. The typical modular floor offers less than ideal traction to dance, sport, pedestrian, and other traffic. The principles described herein present methods and apparatus that provide better traction and more flexibility than previous flooring systems. However, the application of the principles described herein is not limited to the specific embodiments shown. The principles described herein may be used with any flooring system. Moreover, although certain embodiments shown incorporate multiple novel features, the features may be independent and need not all be used together in a single embodiment. Tiles and flooring systems according to principles described herein may comprise any number of the features presented. Therefore, while the description below is directed primarily to interlocking plastic modular floors, the methods and apparatus are only limited by the appended claims.

As used throughout the claims and specification, the term "modular" refers to objects of regular or standardized units or dimensions, as to provide multiple components for assembly of flexible arrangements and uses. A "post" is a support or structure that tends to be vertical. A "post" may be cylindrical, but is not necessarily so. The words "including" and "having," as used in the specification, including the claims, have the same meaning as the word "comprising."

Figure 1:
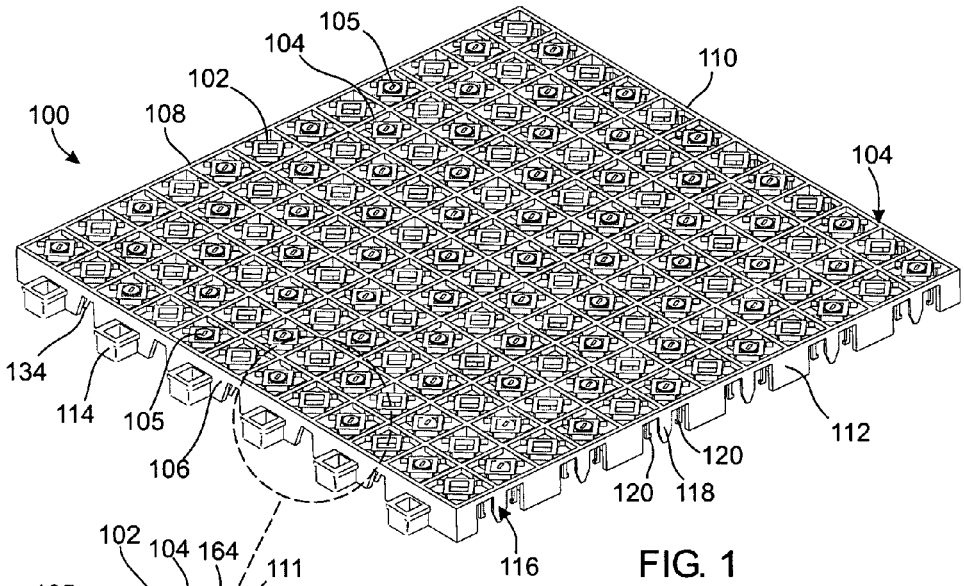
FIG. 1 is a perspective view of a modular floor tile with nonslip inserts according to one embodiment.
Figure 2:
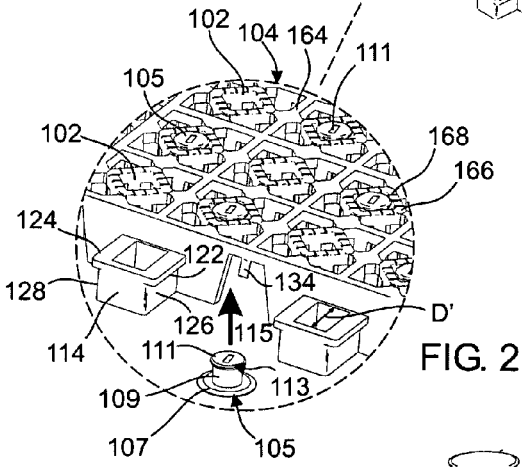
FIG. 2 is a magnified inset of a portion of the modular floor tile of FIG. 1.
Figure 3:
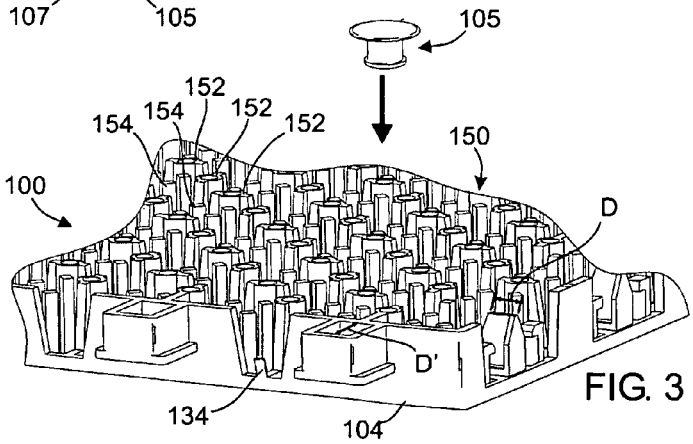
FIG. 3 is a partial bottom assembly view the modular floor tile of FIG. 1.

Referring now to the drawings, FIGS. 1-3 illustrate in partial assembly view a modular floor tile 100 according to one embodiment. The modular floor tile 100 of FIGS. 1-3 may comprise injection molded plastic. The modular tile 100 and other similar or identical tiles may be interlocked according to principles described herein to form a floor, such as a sports court floor discussed below with reference to FIG. 7. However, unlike conventional modular flooring systems, the modular tile 100 facilitates extra traction by the addition of nonslip inserts.

The modular tile 100 comprises a first or top open surface 104. The term "open" indicates that the top open surface 104 includes open holes, gaps, or spaces through which fluid may drain. For example, the modular tile 100 of FIGS. 1-3 may include a plurality of diamond shaped holes 102 patterned relative to the rectangular or square shape of the modular tile 100 as shown. However, any other shape for the gaps 102 and the modular tile 100 may also be used.

Each of the holes 102 in the open surface 104 is receptive of an insert 105. However, it is not necessary for every hole 102 to include an insert 105. For example, FIGS. 1-3 illustrate an insert 105 disposed in every other hole 102. Nevertheless, some embodiments include inserts 105 in every hole 102, and other embodiments may include other spacings between the inserts 105. The insert 105 may be inserted or removed from the modular tile 100. According to some embodiments, however, the insert 105 may be permanently attached to the modular tile 100. The insert 105 is insertable at least partially into the holes 102 and protrudes from the plane of the open surface 104.

The insert 105 may comprise a resilient material, which may be an elastomer such as rubber and may include many different shapes. For example, as shown in FIGS. 1-3, the insert 105 may include a base 107 with a post or compressible column 109 extending normally from the base. The post 109 may terminate at an end 113 with a pad 111 opposite of the base 107. As shown in FIGS. 1-3, the base 107 may be generally circular, and the post 109 may be generally cylindrical. The base 107 and the pad 111 may comprise first and second radial lips, respectively, extending radially from the post 109.

Figure 4:
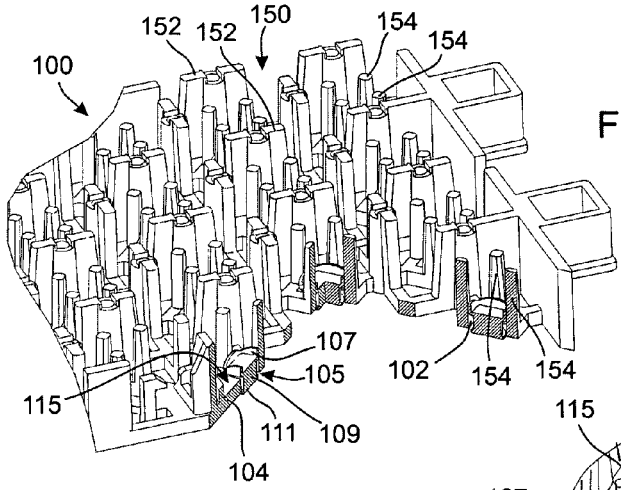
FIG. 4 is a magnified partial cross-sectional view of the modular floor tile of FIG. 1.
Figure 5:
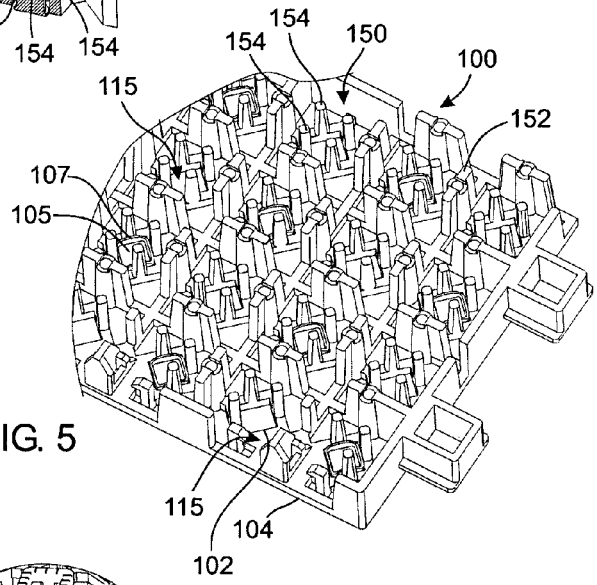
FIG. 5 is a magnified bottom perspective view of the modular floor tile of FIG. 1.

As shown in FIGS. 1-3, the post 109 is sized small enough to pass easily though the holes 102 and protrude from the open surface 104. The base 107, on the other hand, is sized large enough to resist passage though the holes 102. Therefore, the insert 105 may be inserted from the bottom of the modular tile 100 until the base 107 contacts the periphery of the holes 102. As shown in FIGS. 4-5, the base 107 of the insert 105 may nest in a receiver or holder 115 of the modular tile 100. The receiver 115 is sized smaller than the base 107 to provide an interference fit between the insert 105 and the receiver 115 and generally hold the insert 105 tightly in place. However, the insert 105 is resilient and therefore may be removed from the interference fit with the receiver 115 by applying an adequate force to the insert 105. The receiver 115 may comprise a number of legs 154 described in more detail below with reference to FIGS. 3-5. The base 107 deforms around the legs 154 as shown in FIGS. 4-5 to partially hold the insert 105 in place.

Continuing to refer to FIGS. 4-5, the base 107 and the pad 111 may straddle or partially straddle the open surface 104 of the modular floor tile 100. The pad 111 may be sized to slightly resist passage through the holes 102. Therefore, the insert 105 may be inserted into one of the holes 102 by applying a sufficient force to the insert 105 to elastically deform the pad 111 as it passes through the hole 102. The pad 111 may be tapered or rounded to facilitate insertion through the hole 102 in an insertion direction. When the pad 111 emerges through the hole 102, it tends to resume its original shape and resist passing back out of the hole 102 in a direction opposite of the insertion direction. Nevertheless, the pad 111 tends to displace to a generally flush position relative to the open surface 104 upon the application of force. The post 109 is also resilient and compressible, and a sufficient force on the pad 111 (e.g. a person stepping on the pad) causes the post 109 to compress without displacing the base 107 within the receiver 115.

The protruding inserts 105 advantageously provide traction to users of the modular tile 100. As mentioned above, the inserts 105 may be elastomeric, and soft elastomeric materials such as rubber and santoprene provide excellent traction for users. The inserts 105 are compressible as well, providing a comfortable surface for users to walk across. The number of inserts 105 used with the modular tile 100 may be varied according to preference. Moreover, as described below, the modular tile 100 includes an interlocking mechanism for attachment to adjacent tiles. Therefore, multiple modular tiles 100 may interlocked to create a floor of any size and shape. One embodiment of an interlocking mechanism is described in the following paragraphs.

The modular tile 100 includes a plurality of side edges, which, according to the embodiment of FIGS. 1-3, include four side edges 106, 108, 110, 112. At least one of the side edges of the modular tile 100 includes a plurality of loops 114. However, according to the embodiment of FIGS. 1-3, a plurality of loops 114 is disposed in each of the first and second adjacent side surfaces 106, 108. The loops 114 may be spaced along the first and second side surfaces 106, 108 at substantially equal intervals.

Each of the plurality of loops 114 is receptive of a mating locking tab assembly 116 from an adjacent modular tile. According to the embodiment of FIGS. 1-3, each of the third and fourth adjacent side surfaces 110, 112 includes a plurality of locking tab assemblies 116. The modular tile 100 may include an equal number of locking tab assemblies 116 and loops 114. Moreover, the locking tab assemblies 116 may be spaced at the same intervals as the loops 114.

Figure 6:
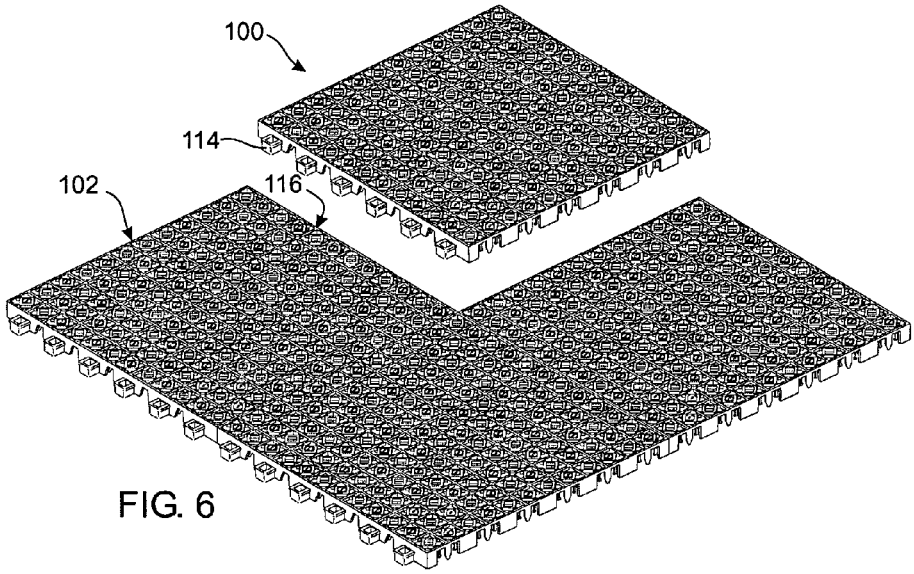
FIG. 6 is a perspective assembly view of multiple modular floor tiles according to one embodiment.

Referring now to FIG. 6, the loops 114 of the modular tile 100 are receptive of the locking tab assemblies 116 of an adjacent modular tile such as a second tile 102. Thus, the first and second modular tiles 100, 102 may be interlocked or connected together. FIG. 6 illustrates three modular tiles already interconnected, and the modular tile 100 being attached to the other three.

Figure 7:
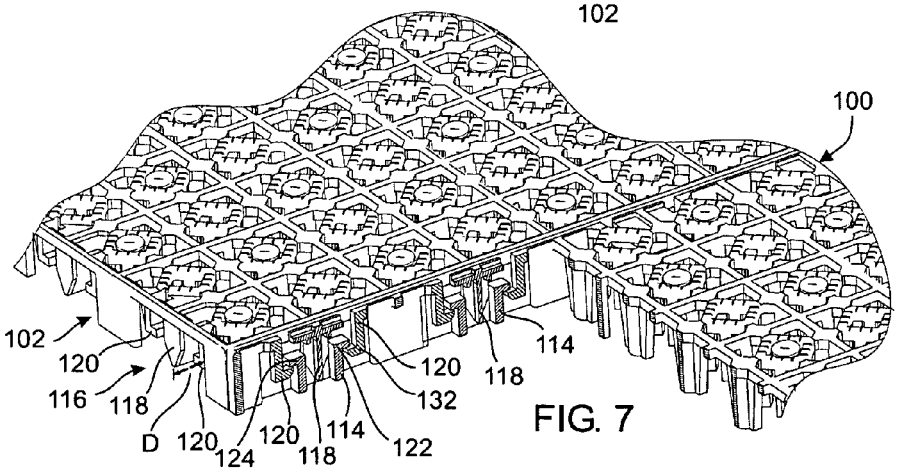
FIG. 7 is partial cross sectional view of the modular floor tiles of FIG. 6 illustrating the connection between tiles according to one embodiment.

FIG. 7 best illustrates the details of the interconnection between adjacent modular tiles 100, 102. Each of the locking tab assemblies 116 may comprise a center post 118 of depth D and flanking hooks 120. The flanking hooks 120 may be cantilevered. In addition, as best shown in FIG. 2, each of the loops 114 comprises a rim or lip, which may include first and second lips 122, 124 protruding from first and second sides 126, 128, respectively, of the loops 114. As the adjacent modular tiles 100 are locked together as shown in FIG. 7, the center post 118 is inserted into the associated loop 114, and the flanking hooks 120 flex around and snap-fit over the associated lips 122, 124. Once snapped over the lips 122, 124, the flanking hooks 120 resist disconnection of the adjacent modular tiles 100. However, the length of the flanking hooks 120 provides a vertical clearance 130 between the lips 122, 124 and prongs 132 of the flanking hooks 120. The vertical clearance 130 allows adjacent, interlocked modular tiles 100 to displace vertically a predetermined distance with respect to one another, even while remaining interlocked. According to some embodiments, the vertical clearance 130 (and thus the vertical displacement) comprises at least about 0.0625 inches, and may be at least about 0.125 inches or more. Moreover, the flanking hooks 120 comprise double locks and operate independent of one another. Therefore, even if one of the flanking hooks 120 breaks or is otherwise incapacitated, the lock between the locking tab assembly 116 and the loop 114 remains intact.

In addition, although the prongs 132 of the flanking hooks 120 provide a double lock against disconnection of the adjacent modular tiles 100, they permit sliding lateral displacement between the adjacent modular tiles 100. A predetermined amount of sliding lateral displacement between the adjacent modular tiles 100 may be controlled, for example, by the depth D of the center post 118, in combination with the depth D' (FIG. 2) of the loop 114. A predetermined clearance between the depth D of the center post 118 and the depth D' (FIG. 2) of the loop 114 may fix the maximum lateral displacement between the adjacent modular tiles 100. According to some embodiments, the predetermined lateral displacement may be at least 0.0625 inches, and may be at least about 0.100-0.125 inches. Thus, the interconnection between adjacent modular tiles 100 according to some embodiments, advantageously permits some relative displacement both vertically and laterally, and provides a more comfortable feel to users, especially at quick stops and starts.

However, although some embodiments facilitate lateral displacement between interlocked modular tiles, a complete floor may tend to look sloppy and misaligned in some configurations. Therefore, according to some embodiments, adjacent modular tiles may be biased or spring loaded to a specific, generally equal spacing therebetween. Referring to FIGS. 1-3 one or more of the side walls 106-112 may include one or more biasing members such as spring fingers 134 disposed therein. The spring fingers 134 may comprise three cantilevered, angled spring fingers spaced between alternating loops 114 and disposed in both of the first and second side walls 106, 108. Nevertheless, the spring fingers 134 may just as effectively be placed in the third and fourth side walls 110, 112, or even in all four side walls. The spring fingers 134 thus tend to bear against adjacent side walls of adjacent tiles, aligning all of the modular floor tiles in a floor to a substantially equal spacing, while also permitting lateral displacement upon the application of a sufficient lateral force.

Each of the modular tiles 100 includes a support system under the top open surface 104. According to some aspects, the support system comprises a multiple-tier suspension system. One embodiment of the multiple-tier suspension system is illustrated in FIGS. 3-5, and comprises a two-tier suspension system 150. The two-tier suspension system 150 comprises a plurality of support legs extending down from the first open surface 104. The plurality of support legs may comprise a first set of primary support legs 152 having a first length, and a second set of support legs 154 having a second length. The second length of the second set of support legs 154 is shorter than the first length of the first set of support legs 152. Therefore, absent a load, only the first set of support legs 154 contacts the ground. The first and second sets of support legs 152, 154 may be arranged in an alternating pattern as shown in FIG. 3. The pattern may comprise alternating rows or columns of first and second sets of support legs 152, 154. In addition, the first set of support legs 152 may each comprise a split or fork leg as shown, and the second set of support legs 154 may comprise clusters of three or four legs. The inserts 105 may be nested in the groups of three or four legs. Thus, the base 107 of the insert 105 may be deformed around the legs 154 by forcing the insert 105 into the cluster of three or four legs, causing the base 107 to bear against the legs, which tends to hold the insert 105 fast. The second set of support legs 154 may thus comprise the receiver 115.

The spacing of the first set of support legs 152 facilitates vertical flexing or springing of each of the modular tiles 100. That is to say, as a load is applied to one or more of the modular tiles 100, 102 on the first open surface 104, the first open surface 104 "gives" or tends to flex, until the second set of support legs 154 contacts the ground. In addition, the inserts 105 tend to compress as they are stepped on. Accordingly, application of the principles described herein may result in a comfortable spring-like modular floor.

Figure 8:
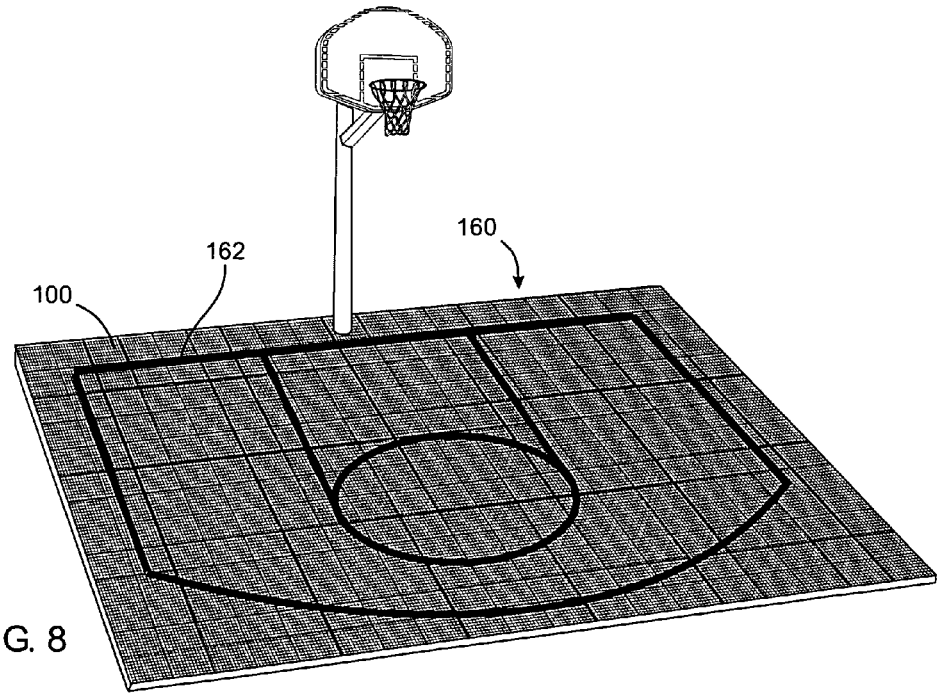
FIG. 8 is a perspective view a modular floor arranged as a sports court according to one embodiment.

The modular tile 100 described above, along with a plurality of additional similar or identical modular tiles, may be arranged in any configuration to create a floor. For example, as shown in FIG. 8, a plurality of modular tiles 100 may be arranged to form a sports court floor 160. The sports court floor 160 may include lines corresponding to regulation sports floor lines, such as the basketball court lines 162 shown in FIG. 7. The lines may be painted onto or otherwise formed in the modular tiles 100.

For many uses of the modular tiles 100, including the sports court floor 160, traction can be important. Therefore, nonslip inserts 105 (FIG. 2) provide a significant advantage over traditional modular floors. According to some embodiments, the modular tiles 100 include multiple traction layers. For example, as shown in FIG. 2, the modular tile 100 comprises four traction layers. A first of the three traction layers may comprise a first webbing 164 that runs in lines generally parallel and perpendicular to edges of the modular tile 100. The first webbing 164 is at a first elevation that may be, for example, at about 0.6875 inches from a ground surface (the height of the side walls 106-112 (FIG. 1) may be about 0.75 inches). A second of the traction layers may comprise the general diamond pattern surface 166 defining the holes 102, and are disposed in between perpendicular lines of the first webbing 164. The diamond pattern surface 166 may be substantially flush with the side wall height at about 0.75 inches. A third traction layer may comprise a plurality of ridges 168 protruding from the diamond pattern surface 166. The plurality of ridges 168 may comprise three ridges in each side of the diamond pattern. The plurality of ridges 168 may be elevated slightly from the diamond pattern surface 166 a distance of about 0.05-0.125 inches. A fourth traction layer may comprise the pad 111 of the protruding insert 105. The four traction layers 164, 166, 168, 111 provide exceptional traction and reduce the risk of slipping and other hazards.

Referring again to FIG. 1, according to some aspects, the modular floor tiles 100 may be made by providing a mold, injecting liquid polymer into the mold, shaping the liquid polymer with the mold to provide a top surface 104 and an interlocking system 114, 116, and solidifying the liquid polymer. The inserts 105 may then be inserted into the holes 102 in the top surface 104 through the bottom of the tile 100 in a first direction indicated by arrows in FIGS. 2-3. The inserts 105 are pushed into the holes 102 until the pads 111 protrude from the top surface 104 and the inserts 105 deform to a snug or interference fit with the receiver 115 (FIG. 4) or other component of the tile 100. Thus the pads 111 and the bases 107 straddle the top surface 104. The shaping of the modular tiles 100 may comprise creating the plurality of loops 114 disposed in at least one side edge 106 (FIG. 1), the loops 114 having a protruding rim 122, and creating a plurality of locking tab assemblies 116 (FIG. 1) disposed in at least one other side edge 108, each of the plurality of locking tabs assemblies 116 (FIG. 1) comprising a center post 118 and flanking hooks 120 (FIG. 1). The method may further comprise varying a depth D (FIG. 7) of the center posts in the mold to adjust the predetermined amount of lateral sliding allowed between adjacent tiles.

Figure 9:
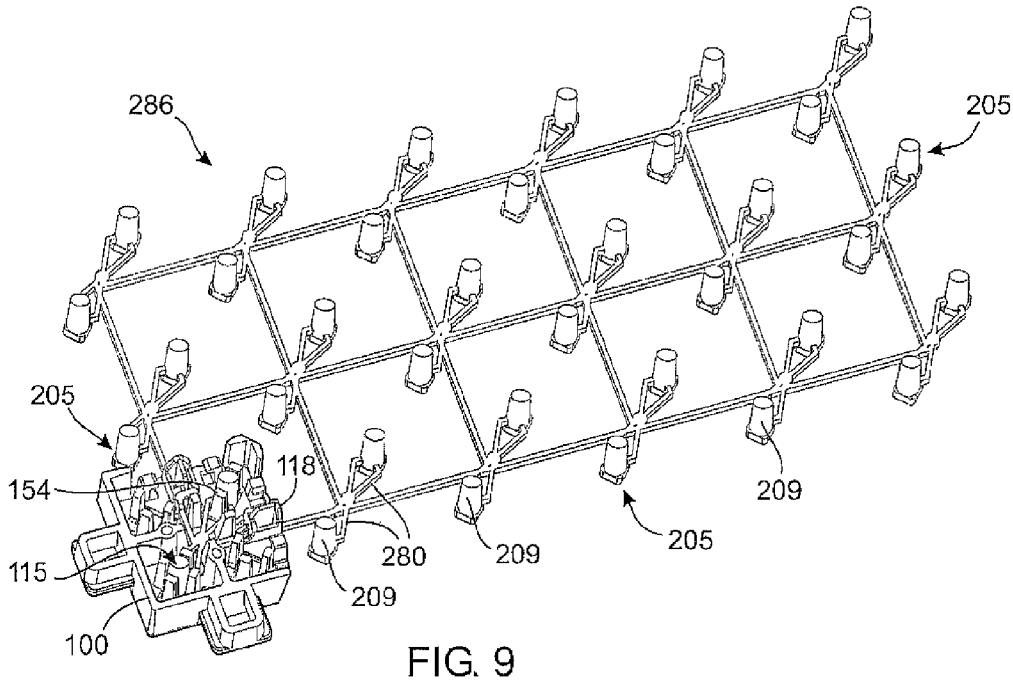
FIG. 9 is a bottom perspective cut-away view of a tile and a plurality of nonslip inserts according to another embodiment.
Figure 10:
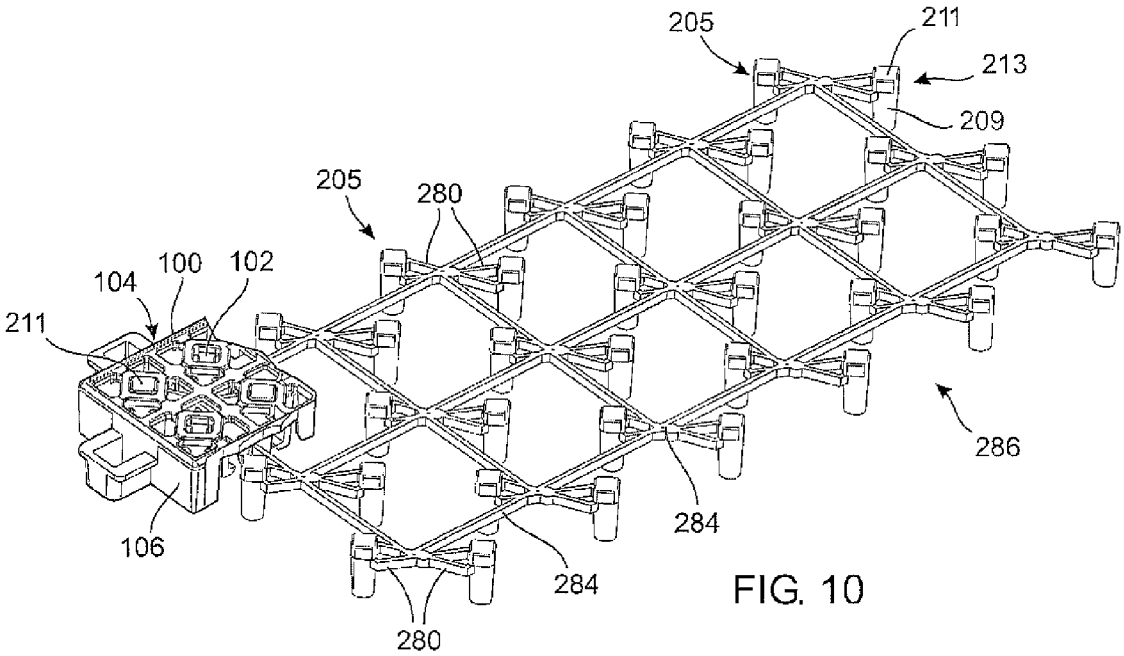
FIG. 10 is a top perspective cut-away view of the tile and nonslip inserts of FIG. 9.
Figure 11:
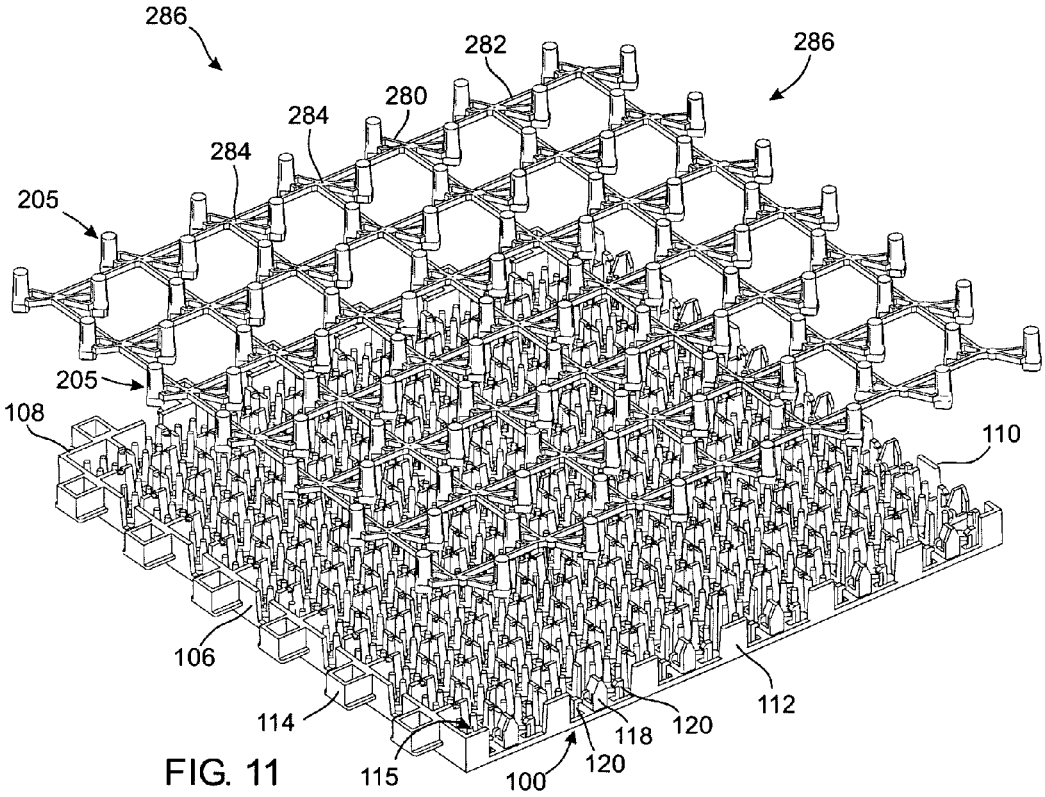
FIG. 11 is an assembly view of a full tile and multiple nonslip inserts according to one embodiment.

Referring next to FIGS. 9-11, another embodiment of nonslip inserts is disclosed. According to one embodiment, the modular floor tile 100 is accompanied by one or more full-length nonslip inserts 205. Each of the holes 102 in the open surface 104 of the modular floor tile 100 is receptive of a full-length insert 205. However, as with the inserts 105 described above, it is not necessary for every hole 102 to include a full-length insert 205. For example, FIGS. 9-11 illustrate a full-length insert 205 disposed in every other hole 102. Nevertheless, some embodiments include full-length inserts 205 in every hole 102, and other embodiments may include other spacings between the full-length inserts 205. The full-length inserts 205 may be inserted or removed from the modular tile 100. According to some embodiments, however, the full length inserts 205 may be permanently attached to and comprise the modular tile 100. The full-length inserts 205 are insertable at least partially into the holes 102 and protrude from the plane of the open surface 104.

Unlike the inserts 105 illustrated above, the full-length inserts 205 may be substantially equal in length to, or slightly longer than, the side walls 106-112. Therefore, the full-length inserts 205, when the assembled in the floor tile 100 and setting on a support surface, cannot fall out of the holes 102. The full length inserts 205 contact the ground or other support surface and extend though the open surface 104 in the floor tile 100.

The full-length inserts 205 may comprise a resilient material, which may be an elastomer such as rubber, or it may comprise plastic or other nonslip materials. The full-length insert 205 may include many different shapes. For example, as shown in FIGS. 9-11, the full-length insert 205 may include a base comprising a post or compressible column 209. The post 209 may be generally cylindrical, and may include a taper. The post 209 may terminate at an end 213 with a pad 211. The pad may be rectangular or square. According to one embodiment, the pad 211 is substantially the same shape as the holes 102 in the floor tile 100. The pad 211 may be slightly oversized with respect to the holes 102, creating a snug or interference fit between the pad 211 and the holes 102.

The full-length inserts 205 may be inserted from the bottom of the modular tile 100. As shown in FIG. 9, according to embodiment, the full-length inserts 205 may nest in the receivers or holders 115 of the modular tile 100. According to one embodiment, the full-length inserts 205 may come in pairs and be interconnected by a pair of generally triangular webbings 280. When assembled, one of the legs 154 of the floor tile 100 may extend through the triangular webbing 280 as shown in FIG. 9.

As shown in FIG. 11, according to one embodiment, a plurality of full-length inserts 205 may be injection molded together as a unit. The unit may comprise substantially the same shape as the floor tile 100. Therefore, a set or plate 286 of full-length inserts 205 may be pressed into the holes 102 of the floor tile 100 at once. A webbing, for example a generally rectangular webbing 282, may interconnect the full-length inserts 205 in the same general shape as the floor tile 100 or open surface 104. The webbing 282 may be integrally formed as a single piece with the full-length inserts 205, and may include a plurality of openings defined between the full-length inserts 205. The generally triangular webbing 280 may be offset at an angle with respect to the generally rectangular webbing 282. For example, according to one embodiment, the generally triangular webbings 280 interconnecting pairs of full length inserts 205 may be arranged at forty-five degree angles from intersection points 284 of the generally rectangular webbing 280. However, certain portions of the generally rectangular webbing 282 may break or be cut as the plate 286 of full length inserts 205 is installed. Portions of the generally rectangular webbing 282 may be cut because the generally rectangular webbing 280 may interfere with other components of the floor tile 100. For example, as best shown in FIG. 9, the generally rectangular webbing 280 may interfere with the center post 118. Therefore, the generally rectangular webbing 280 may be cut or predisposed to break as the full length inserts 205 of the plate 286 are pressed into the holes 102. It will be understood by those of ordinary skill in the art having the benefit of this disclosure, that the full length inserts 205 are not necessarily interconnected in the configuration shown in FIGS. 9-11. According to one embodiment, each full-length insert 205 is completely separate and individual. Other embodiments may include any number of full-length inserts 205 interconnected in any pattern.

Continuing to refer to FIGS. 9-11, the full-length inserts 205 may straddle or partially straddle the open surface 104 of the floor tile 100. As mentioned above, the pad 211 may be sized to slightly resist passage through the holes 102. Therefore, the full-length insert 205 may be inserted into one of the holes 102 by applying a sufficient force to the full-length insert 205 to elastically deform the pad 211 as it passes through the hole 102. The pad 211 tends to displace to a generally flush position relative to the open surface 104 upon the application of force. The post 209 is resilient and compressible, and a sufficient force on the pad 211 (e.g. a person stepping on the pad) causes the post 209 to compress.

The protruding full-length inserts 205 provide traction to users of the modular tile 100. As mentioned above, the full-length inserts 205 may be elastomeric, and soft elastomeric materials such as rubber and santoprene provide excellent traction for users. The full-length inserts 205 may be compressible as well, providing a comfortable surface for users to walk across. Some embodiments of the insert 105 and the full-length insert 205, however, may be rigid. The number of full-length inserts 205 used with the modular tile 100 may be varied according to preference. Moreover, as described above, the modular tile 100 includes an interlocking mechanism for attachment to adjacent tiles. Therefore, multiple modular tiles 100 may interlocked to create a floor of any size and shape.

The preceding description has been presented only to illustrate and describe exemplary embodiments. It is not intended to be exhaustive or to limit the claims. Many modifications and variations are possible in light of the above teaching. The scope of the invention is defined by the following claims.

The invention claimed is:

1. A modular floor tile, comprising:

a first open surface defining a plurality of gaps;

a plurality of edge surfaces;

a plurality of support members extending opposite the first open surface;

an interlocking mechanism for attachment to adjacent tiles;

a plurality of inserts disposed in the plurality of gaps of the first open surface and protruding upward from the first open surface, the plurality of inserts being interconnected and integrally formed as a single piece with a webbing, the webbing including a plurality of openings, wherein at least some of the plurality of openings in the webbing each having a plurality of the support members positioned therein.

2. A modular floor tile according to claim 1 wherein the plurality of inserts comprise a length equal to or greater than a length of the plurality of edge surfaces.

3. A modular floor tile according to claim 1 wherein the plurality of inserts comprise a full length insert, the full length insert comprising a generally cylindrical post and a pad shaped substantially the same as the at least one gap in the first open surface.

4. A modular floor tile according to claim 1 wherein the plurality of inserts comprise a base and a post extending from the base.

5. A modular floor tile according to claim 1 wherein the plurality of inserts comprise a plate of multiple inserts, the plate shaped substantially the same as the first open surface.

6. A modular floor tile according to claim 1 wherein the plurality of inserts comprise a base, a compressible column, and a pad.

7. A modular floor tile according to claim 1 wherein the plurality of inserts comprise a base, a compressible column, and a pad;

wherein a force on the pad causes the compressible column to compress, wherein the pad may be forced to a generally flush arrangement with the first open surface without displacing the base.

8. A modular floor tile according to claim 1 wherein the plurality of gaps of the first open surface comprises a plurality of shapes arranged in a pattern;

wherein the plurality of inserts comprise a base and a post extending from the base;

wherein the post is sized small enough to pass through one of the plurality of shapes, and the base is sized large enough to resist passage through one of the plurality of shapes.

9. A modular floor tile according to claim 1 wherein the plurality of gaps of the first open surface comprises a plurality of shapes;

wherein the plurality of inserts comprise a post straddling the first open surface at the plurality of gaps.

10. A modular floor tile according to claim 1 wherein the plurality of inserts comprise a removable insert made of an elastomer.

11. A modular floor tile according to claim 1 wherein the interlocking mechanism comprises:

a plurality of lipped loops disposed in at least one of the plurality of edge surfaces;

a plurality of locking tab assemblies disposed in at least one of the plurality of edge surfaces;

wherein each of the plurality of locking tab assemblies comprises a center post that extends through one of the lipped loops, and flanking hooks that connect with a lip of the lipped loop through which the center post extends.

12. An apparatus, comprising:

a modular floor, the modular floor comprising:

a plurality of interlocking tiles, each of the plurality of interlocking tiles comprising:

a top surface comprising a plurality of open holes;

a plurality of support members extending opposite the top surface;

a plurality of nonslip inserts which protrude upward from the top surface through at least one of the plurality of open holes, the plurality of nonslip inserts being interconnected and integrally formed as a single piece with a webbing, the webbing including a plurality of openings, wherein at least some of the plurality of openings in the webbing each having a plurality of the support members positioned therein.

13. An apparatus according to claim 12 wherein each of the plurality of interlocking tiles comprises a bottom, the bottom including a plurality of receivers sized to hold the nonslip inserts.

14. An apparatus according to claim 12 wherein the nonslip inserts comprise a resilient member disposed through one of the plurality of open holes and held in place by an interference fit with a holder in one of the plurality of interlocking tiles.

15. An apparatus according to claim 12 wherein the nonslip inserts comprise a length equal to or greater than a thickness of the interlocking tiles.

16. An apparatus according to claim 12 wherein the plurality of support members comprise:

a plurality of support legs extending from the first open surface, the plurality of support legs comprising a first set of support legs having a first length, and a second set of support legs having a second length, the second length being shorter than the first length;

wherein the first and second sets of support legs are arranged in an alternating pattern comprising:

a first leg of the first length;

a group of three to four legs of the second length;

wherein the nonslip inserts are nested in and in contact with the group of three to four legs.

17. A method of increasing traction of a modular floor, comprising:

providing an interlocking modular tile having a first open surface;

providing a plurality of support members extending opposite the first open surface;

providing a plurality of inserts, the plurality of inserts being interconnected and integrally formed as a single piece with a webbing, the webbing including a plurality of openings, wherein at least some of the plurality of openings in the webbing each having a plurality of the support members positioned therein;

inserting the plurality of inserts into a surface of the interlocking modular tile;

protruding the inserts upward from the first open surface.

18. A method of increasing traction of a modular floor according to claim 17 wherein the inserting further comprises fitting the inserts into a nest by an interference fit.

19. A method of increasing traction of a modular floor according to claim 17 wherein the inserting comprises pressing the inserts through gaps in the first open surface in a first direction.

20. A method of making a modular tile, comprising:

forming a tile body having a top surface including a plurality of open shapes, and a plurality of support members extending opposite the top surface;

providing a plurality of elastomeric inserts that are interconnected and integrally formed as a single piece with a webbing, the webbing including a plurality of openings, wherein at least some of the plurality of openings in the webbing each having a plurality of the support members positioned therein;

pressing the plurality of elastomeric inserts into at least some of the plurality of open shapes until the plurality of elastomeric inserts extend upward from the top surface.

21. A method of making a modular tile according to claim 20, further comprising maintaining an orientation of the plurality of elastomeric inserts by deforming each insert into a tight fit with the tile body.

22. A method of making a modular tile according to claim 20 wherein the providing a plurality of elastomeric inserts comprises forming the inserts longer than a thickness of the tile body.

23. A method of making a modular tile according to claim 20 wherein providing the plurality of inserts comprises forming a base with a post extending from the base.

24. An apparatus according to claim 12 wherein the plurality of nonslip inserts are coupled together independent of the respective interlocking tile.

25. A modular floor tile according to claim 1 wherein at least one of the plurality of inserts includes a rectangular cross section in a portion of the insert that protrudes upward from the first open surface, and a circular cross-section in a portion of the insert that is positioned below the first open surface.

26. A modular floor tile according to claim 1 wherein the webbing is connected to the inserts at a location spaced from opposing upper and lower ends of the inserts.

27. A modular floor tile, comprising:

a first open surface defining a plurality of gaps;

a plurality of edge surfaces;

a plurality of support members extending opposite the first open surface;

an interlocking mechanism for attachment to adjacent tiles;

a plurality of inserts disposed in the plurality of gaps of the first open surface and protruding upward from the first open surface, the plurality of inserts being interconnected and integrally formed as a single piece with a webbing, the webbing including a plurality of openings, wherein a plurality of the support members are positioned within at least some of the openings in the webbing;

wherein the interlocking mechanism comprises:

a plurality of lipped loops disposed in at least one of the plurality of edge surfaces;

a plurality of locking tab assemblies disposed in at least one of the plurality of edge surfaces;

wherein each of the plurality of locking tab assemblies comprises a center post that extends through one of the lipped loops, and flanking hooks that connect with a lip of the lipped loop through which the center post extends.

28. An apparatus, comprising: a modular floor, the modular floor comprising:

a plurality of interlocking tiles, each of the plurality of interlocking files comprising:

a top surface comprising a plurality of open holes;

a plurality of support members extending opposite the top surface; a plurality of nonslip inserts which protrude upward from the top surface through at least one of the plurality of open holes, the plurality of nonslip inserts being interconnected and integrally formed as a single piece with a webbing, the webbing including a plurality of openings, wherein a plurality of the support members are positioned within at least some of the openings in the webbing;

wherein the plurality of support members comprise a plurality of support legs extending from the first open surface, the plurality of support legs comprising a first set of support legs having a first length, and a second set of support legs having a second length, the second length being shorter than the first length;

wherein the first and second sets of support legs are arranged in an alternating pattern comprising: a first leg of the first length; a group of three to four legs of the second length; wherein the nonslip inserts are nested in and in contact with the group of three to four legs.

29. An apparatus according to claim 28 wherein the nonslip inserts comprise a length equal to or greater than a thickness of the interlocking tiles.

* * * * *